US005797735A

United States Patent [19]

Ishikawa et al.

[11] Patent Number: 5,797,735

[45] Date of Patent: Aug. 25, 1998

[54] FLUID MACHINE HAVING BALANCE CORRECTION

[75] Inventors: Susumu Ishikawa; Masao Tateno; Koji Tomita, all of Tochigi-ken, Japan

[73] Assignee: Tochigi Fuji Sangyo Kabushiki Kaisha, Japan

[21] Appl. No.: 623,156

[22] Filed: Mar. 28, 1996

[30] Foreign Application Priority Data

Apr. 3, 1995 [JP] Japan ..... 7-077827
Sep. 13, 1995 [JP] Japan ..... 7-235607

[51] Int. Cl.[6] ..... F01C 1/16; F01C 21/08

[52] U.S. Cl. ..... 418/151; 418/201.1; 418/206.1

[58] Field of Search ..... 418/151, 201.1, 418/206.1, 206.5

[56] References Cited

U.S. PATENT DOCUMENTS

| | | | |
|---|---|---|---|
| 56,614 | 7/1866 | Roots et al. | 418/206.5 |
| 2,325,617 | 8/1943 | Lysholm et al. | 418/201.1 |
| 2,853,766 | 9/1958 | Wellington | 29/888.025 |
| 2,857,779 | 10/1958 | Frei | 74/466 |
| 2,905,096 | 9/1959 | Thomas et al. | 418/151 |
| 2,944,732 | 7/1960 | Lorenz | 418/206.5 |
| 5,290,150 | 3/1994 | Takahashi et al. | 418/201.1 |

FOREIGN PATENT DOCUMENTS

| | | | |
|---|---|---|---|
| 0 637 691 | 2/1995 | European Pat. Off. . | |
| 693372 | 7/1940 | Germany . | |
| 696509 | 9/1940 | Germany | 418/206 |
| 882 746 | 7/1953 | Germany . | |
| 24 09 554 | 9/1975 | Germany . | |
| 3445653 | 6/1986 | Germany | 418/151 |
| 60-259787 | 12/1985 | Japan | 418/151 |
| 2305393 | 12/1990 | Japan | 418/151 |
| 409853 | 5/1934 | United Kingdom | 418/206 |
| WO 93/14314 | 7/1993 | WIPO . | |

*Primary Examiner*—John J. Vrablik
*Attorney, Agent, or Firm*—Graham & James LLP

[57] ABSTRACT

An object of the present invention is to provide a rotor of a fluid machine in which the rotor can be made light in weight and moment of inertia of the rotor can be reduced and the rotor can be easily balanced in its rotating direction. In this rotor of a fluid machine, a fluid is compressed and pumped by a pair of rotors engaged with each other. A hollow portion is formed within a tooth stripe portion of one rotor. A thickness forming portion for a balance correction is formed in an opening portion of this hollow portion to balance the rotor in its rotating direction and is projected on an inner circumferential side of the hollow portion.

3 Claims, 13 Drawing Sheets

FLUID MACHINE HAVING BALANCE CORRECTION

BACKGROUND OF THE INVENTION

The present invention relates to a rotor of a fluid machine for compressing and pumping a fluid by a pair of rotors engaged with each other.

For example, when the above fluid machine is conventionally used in a great change in the number of rotations such as a supercharger of an engine for an automobile, there are problems of a reduction in operating efficiency of the fluid machine, etc. when the rotor is heavy in weight and moment of inertia of the rotor is large. Accordingly, a hollow hole is formed by lightening a tooth forming portion of the rotor along a tooth stripe in an axial direction thereof so as to make the rotor light in weight and reduce the moment of inertia of the rotor.

For example, the conventional fluid machine of this kind is shown in Japanese laid open patent Nos. 4-12189 and 4-311694.

The former shows a Roots type blower. As shown in FIG. 1, a sucking inlet port 605 and a discharging port 607 are opposed to each other in a rotor housing 603 in this Roots type blower 601. A rotor chamber 609 communicated with the sucking inlet port 605 and the discharging port 607 is formed.

A first rotor shaft 611 and a second rotor shaft 613 rotatably supported by the rotor housing 603 are arranged in the rotor chamber 609 in a direction perpendicular to a line connecting the sucking inlet port 605 and the discharging port 607 to each other. A first rotor 615 and a second rotor 617 are respectively mounted and fixed to the first rotor shaft 611 and the second rotor shaft 613 in a state in which phases of the first and second rotors are different from each other by 90°.

Hollow holes 619 and 621 are respectively formed in a convex tooth forming portion 615*a* of the first rotor 615 and a convex tooth forming portion 617*a* of the second rotor 617 along an axial direction of each of the tooth forming portions so that the rotors 615 and 617 are made light in weight and the moments of inertia of the rotors are reduced.

One end side of each of the rotor shafts 611 and 613 is inserted into a gear chamber adjacent to the rotor chamber 609 and is connected to a gear transmission mechanism within this gear chamber such that this one end side is moved in association with the gear transmission mechanism. A pulley for driving is attached to the other end side of the first rotor shaft 611.

When rotating force is inputted to the pulley for driving, this rotating force is transmitted to the first rotor 615 through the first rotor shaft 611 and is also synchronously transmitted to the second rotor 617 through the gear transmission mechanism and the second rotor shaft 613 from the first rotor shaft 611. The first rotor 615 and the second rotor 617 are rotated while these rotors are engaged with each other in a noncontact state. Thus, a fluid sucked from the sucking inlet port 605 is compressed by both the rotors 615 and 617 and is discharged from the discharging port 607.

The latter shows a screw compressor 701 shown in FIG. 2. As shown in FIG. 2, a male rotor 705 has a plurality of convex tooth forming portions 705*a*. A female rotor 707 has concave portions 707*a* respectively engaged with the tooth forming portions 705*a*. The male rotor 705 and the female rotor 707 are engaged with each other within a casing 703. The male rotor 705 and the female rotor 707 are respectively mounted and fixed to a male rotor shaft 709 and a female rotor shaft 711 rotatably supported by the casing 703.

An unillustrated sucking inlet port is formed on one end side of the casing 703 in its axial direction. A discharging port is formed on the other end side of the casing 703 in its axial direction.

A hollow hole 713 is formed within each of the convex tooth forming portions 705*a* of the male rotor 705 along an axial direction thereof so that the male rotor 705 is made light in weight and the moment of inertia of the male rotor 705 is reduced.

One end side of each of the rotors 709 and 711 is connected to an unillustrated transmission mechanism such that this one end side is moved in association with this transmission mechanism. An unillustrated pulley for driving is attached to one rotor shaft, e.g., the male rotor shaft 709.

When rotating force is inputted to the pulley for driving, this rotating force is transmitted to the male rotor 705 through the male rotor shaft 709 and is also synchronously transmitted to the female rotor 707 through the transmission mechanism and the female rotor shaft 711 from the male rotor shaft 709. The pair of rotors 705 and 707 are rotated while these rotors are engaged with each other in a noncontact state. Thus, while a fluid sucked from the sucking inlet port is compressed by these rotors, this fluid is pumped and discharged from the discharging port.

SUMMARY OF THE INVENTION

In the fluid machine of this kind, it is necessary to assemble the pair of rotors with a small clearance therebetween so as to rotate these rotors while the noncontact state of these rotors is held and these rotors are engaged with each other. Therefore, it is necessary to balance each of the rotors in its rotating direction. The balance of each of the rotors in its rotating direction is corrected by forming small holes, etc. on both end faces of each of the rotors in its axial direction.

However, in the fluid machine in each of the above conventional examples, the hollow hole is formed by lightening the interior of a tooth forming portion of each of the rotors so as to make the rotors light in weight and reduce the moments of inertia of the rotors. Therefore, the conventional fluid machine has a problem of unbalance of each of the rotors in its rotating direction since no balance correcting portion for forming small holes, etc. for balancing each of the rotors in its rotating direction is formed on an axial end face of each of the rotors.

Therefore, an object of the present invention is to provide a rotor of a fluid machine in which the rotor can be made light in weight and moment of inertia of the rotor can be reduced and the rotor can be easily balanced in its rotating direction.

The above object can be achieved by a rotor of a fluid machine which is constructed by a pair of rotors fixed onto respective fixing shafts and engaged with each other by input driving force transmitted to one rotating shaft to compress or pump a fluid and is also constructed by a casing having a flow inlet port and a flow outlet port of the fluid. A hollow portion is formed in a tooth stripe portion of at least one rotor of the pair or rotors such that the hollow portion extends along a tooth stripe direction and has an opening portion opened to at least one end face among both end faces of the rotor in its rotating axis direction. A thickness forming portion for a balance correction correcting balance of the rotor in its rotating direction and projected onto an inner circumferential side of the hollow portion is formed in the opening portion of the hollow portion.

In this rotor of the fluid machine, the thickness forming portion for a balance correction projected on an inner circumferential side of the hollow portion is formed in the opening portion. Accordingly, this thickness forming portion for a balance correction can be utilized in balance correcting processing using a drill, etc. so that the balance correction can be easily made.

Since the balance correction utilizing the thickness forming portion for a balance correction can be thus made, it is not necessary to increase the thickness of the entire hollow portion and narrow the opening portion so as to balance the rotor. Accordingly, rotating balance of the hollow rotor can be well adjusted while light weight and small moment of inertia of the hollow rotor are held.

The opening portion is thick in the thickness forming portion for a balance correction so that strength of the rotor near the opening portion is improved. Accordingly, expansion of the rotor on a side of the opening portion and contact, burning, vibration, etc. of this rotor, another rotor and a casing caused by this expansion are prevented even when strong centrifugal force is applied to the rotor at a high speed rotating time. Therefore, function and performance of the rotor are normally held.

Thus, while the rotor is constructed by a hollow structure to reduce weight and moment of inertia thereof, rotating balance of the hollow rotor can be easily corrected and the opening portion is strengthened so that efficiency of the rotor is improved.

Further, the thickness forming portion for a balance correction may be constructed by a balancer partially projected from an inner circumferential face of the hollow portion in cross section crossing the tooth stripe direction.

In this construction, the rotor balance is corrected by processing the balancer by a drill, etc. Accordingly, while the rotor is constructed by a hollow structure, the rotating balance is easily corrected. Further, the opening portion is strengthened by the balancer so that contact, burning, vibration, a reduction in performance of the rotor, etc. are prevented and efficiency of the rotor is improved.

Further, the thickness forming portion for a balance correction may be constructed by a wall thickness portion projected in a wide range from an inner circumferential face of the hollow portion in cross section crossing the tooth stripe direction.

In this construction, the rotor balance is corrected by processing the wall thickness portion by a drill, etc. Accordingly, while the rotor is constructed by a hollow structure, the rotating balance of the rotor is easily corrected. The opening portion is further strengthened by the wall thickness portion projected from the wide range of the inner circumferential face. Accordingly, expansion of the rotor on a side of the opening portion and contact, burning, vibration, etc. of this rotor, another rotor and a casing caused by this expansion are prevented even when strong centrifugal force is applied to the rotor at a high speed rotating time. Therefore, function and performance of the rotor are normally held.

Further, the thickness forming portion for a balance correction may be constructed by a columnar portion connecting inner circumferential faces on a tooth tip side and a tooth root side to each other along the opening portion in cross section crossing the tooth stripe direction.

In this construction, the rotor balance is corrected by processing the columnar portion by a drill, etc. Accordingly, while the rotor is constructed by a hollow structure, the rotating balance of the rotor is easily corrected. The opening portion is further strengthened by the columnar portion connecting the tooth tip side and the tooth root side of the inner circumferential faces to each other. Accordingly, contact, burning, vibration, a reduction in performance of the rotor, etc. are further prevented and efficiency of the rotor is improved.

Further, the thickness forming portion for a balance correction may be constructed by a wall thickness portion projected in a wide range from an inner circumferential face of the hollow portion in cross section crossing the tooth stripe direction, and may be also constructed by a balancer partially projected from this inner circumferential face and formed until a deep side of the hollow portion from the wall thickness portion.

In this construction, the balancer is formed until the deep side of the hollow portion from the wall thickness portion. Therefore, after a drill, etc. are inserted by a depth of the wall thickness portion from the opening portion to correct the rotor balance and the wall thickness portion is cut and removed, the rotor balance can be corrected by further cutting and removing the balancer if the drill, etc. are further deeply inserted. Accordingly, a large cut weight amount for adjusting the rotor balance can be secured so that a balance adjusting operation can be performed further easily and precisely.

Further, the thickness forming portion for a balance correction may be constructed by a columnar portion connecting inner circumferential faces on a tooth tip side and a tooth root side to each other along the opening portion in cross section crossing the tooth stripe direction, and may be also constructed by a balancer partially projected in a narrow range from each of the inner circumferential faces and formed until a deep side of the hollow portion from the wall thickness portion.

In this construction, the balancer is formed until the deep side of the hollow portion from the columnar portion. Therefore, after a drill, etc. are inserted by a depth of the columnar portion from the opening portion to correct the rotor balance and the columnar portion is cut and removed, the rotor balance can be corrected by further cutting and removing the balancer if the drill, etc. are further deeply inserted. Accordingly, a large cut weight amount for adjusting the rotor balance can be secured so that a balance adjusting operation can be performed further easily and precisely.

Further, an outside end face of the thickness forming portion for a balance correction may be approximately formed on the same face as an end face of the rotor.

In this construction, an end face area of the rotor on a side of the opening portion is increased so that a sealing property of the pressurized fluid is improved. Accordingly, efficiency of the fluid machine is correspondingly improved.

Further, a flow preventing member for preventing a flow of the fluid along the tooth stripe direction may be formed in the hollow portion.

In this construction, no fluid is communicated between a sucking side end face and a discharging side end face of the rotor. Accordingly, no fluid is leaked through the hollow portion and no efficiency of the rotor is reduced even when this rotor is arranged in a screw compressor.

DESCRIPTION OF THE PREFERRED EMBODIMENTS

A first embodiment of the present invention will next be described with reference to the drawings.

Figure 1:
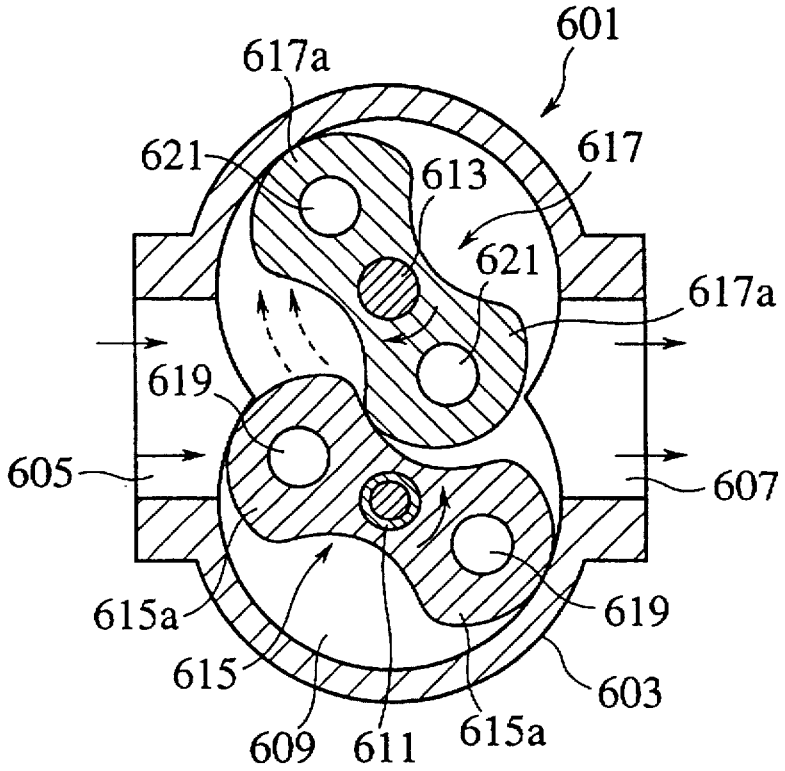
FIG.1 PRIOR ART
FIG. 1 is a cross-sectional view of a rotor of a fluid machine in one conventional example.
Figure 2:
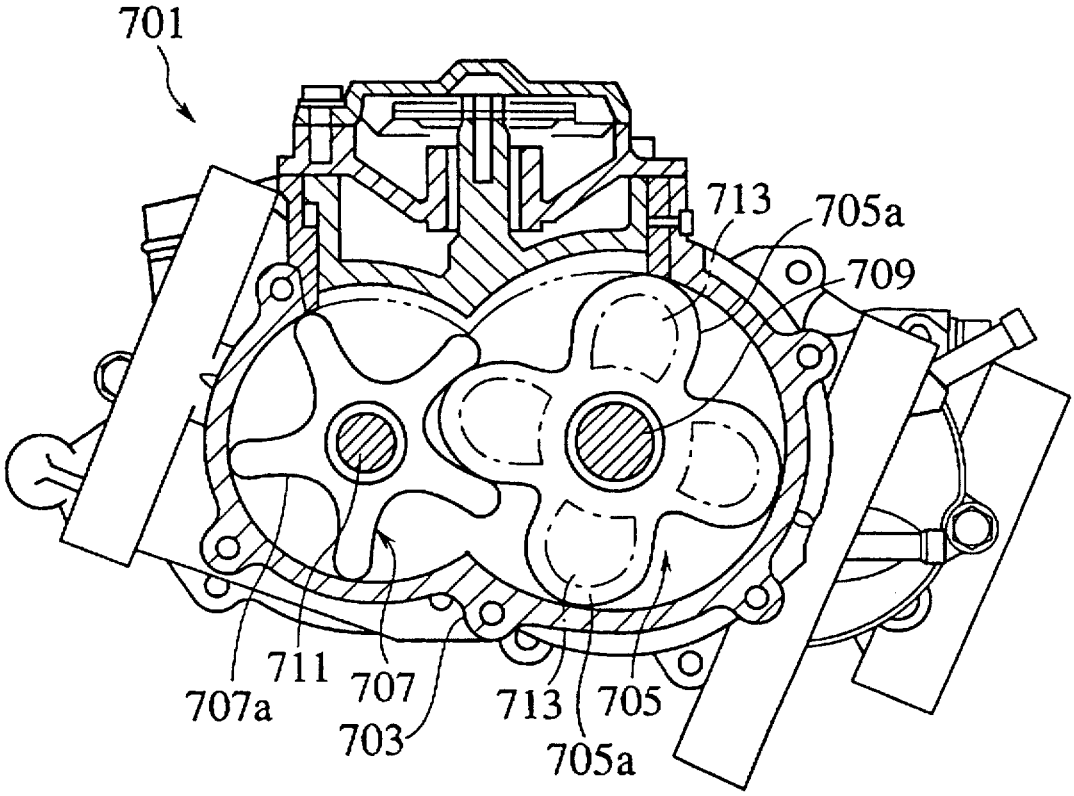
FIG.2 PRIOR ART
FIG. 2 is a cross-sectional view of a rotor of a fluid machine in another conventional example.
Figure 3:
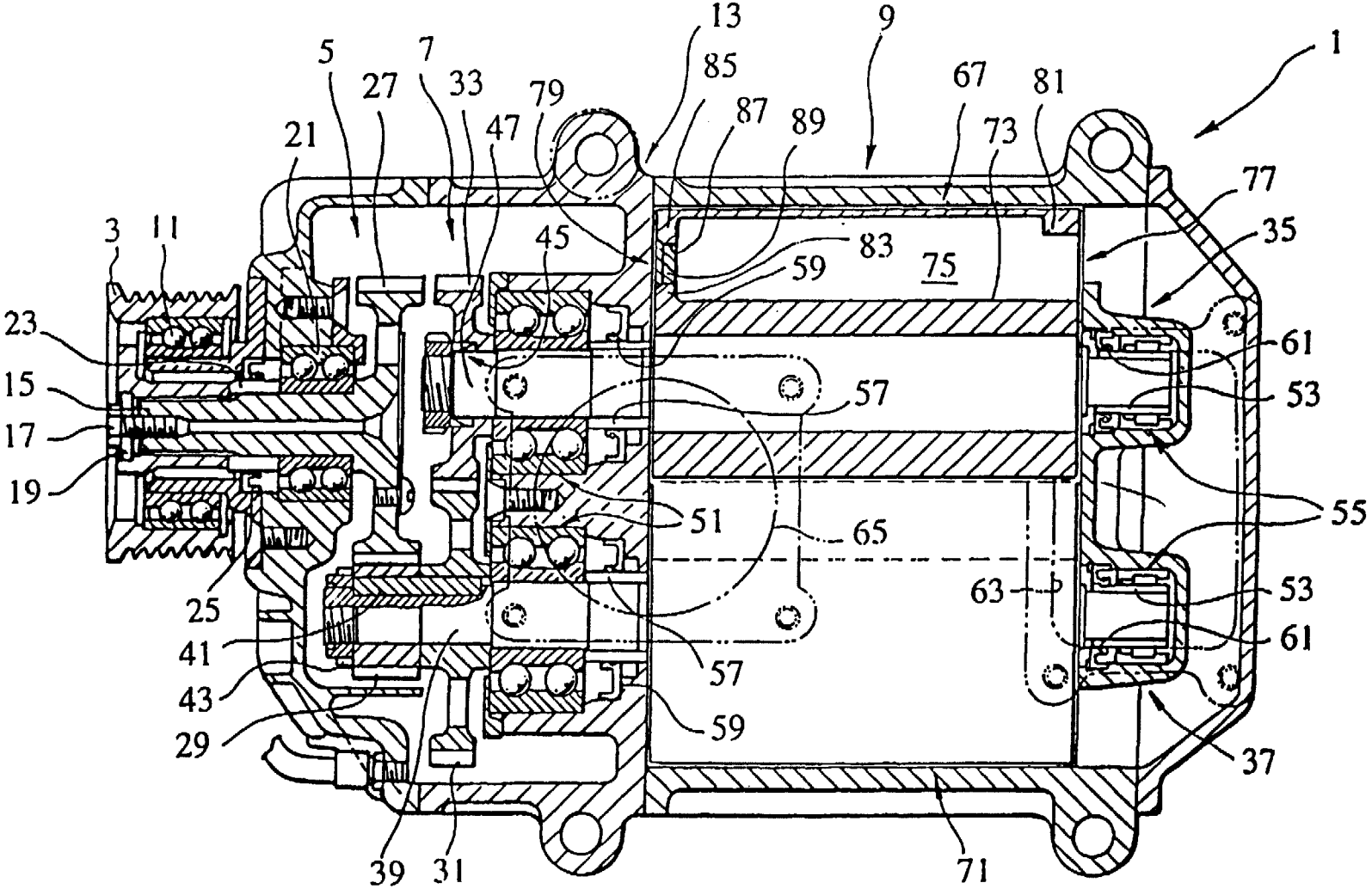
FIG. 3 is a cross-sectional view of a supercharger in accordance with a first embodiment of the present invention in which a male type screw rotor is shown in section III—III of FIG. 6.
Figure 4:
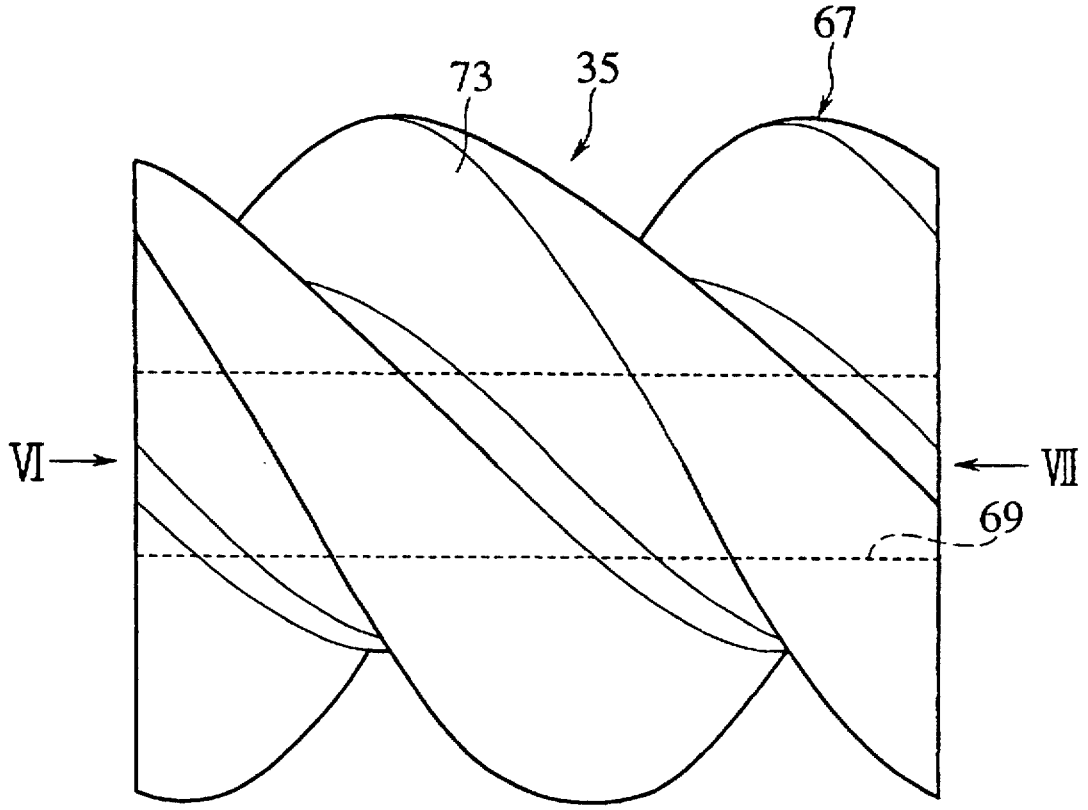
FIG. 4 is a front view of the male type screw rotor of FIG. 3.
Figure 5:
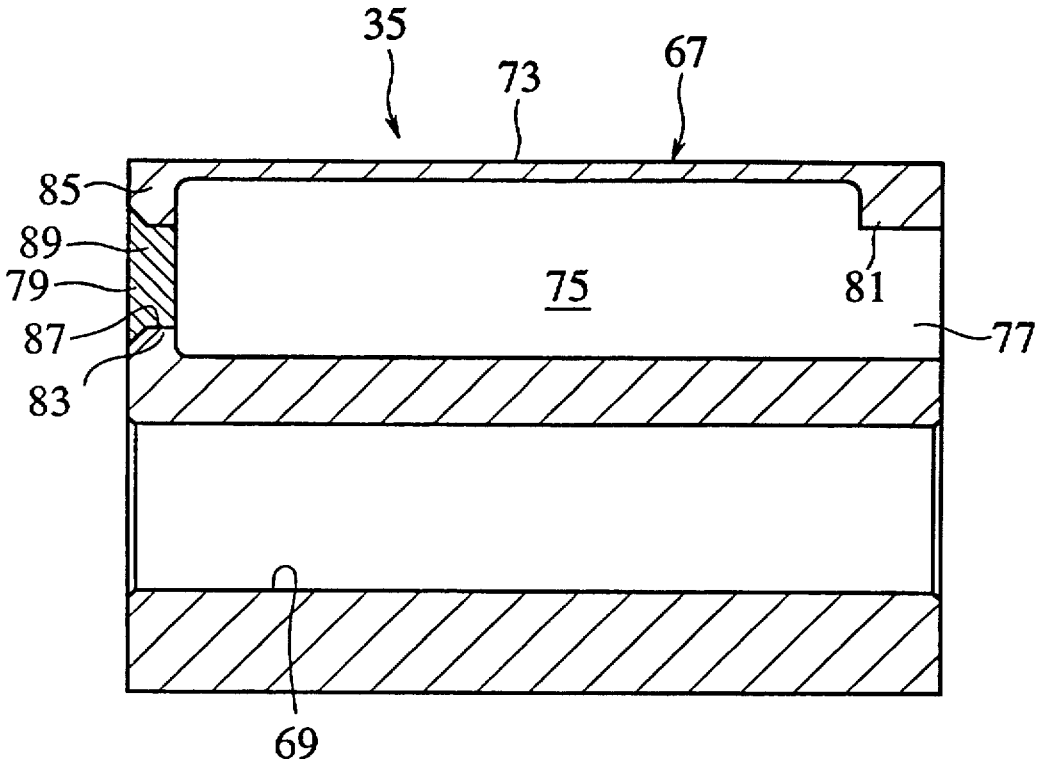
FIG. 5 is an enlarged view of a main portion of the male type screw rotor of FIG. 3.
Figure 6:
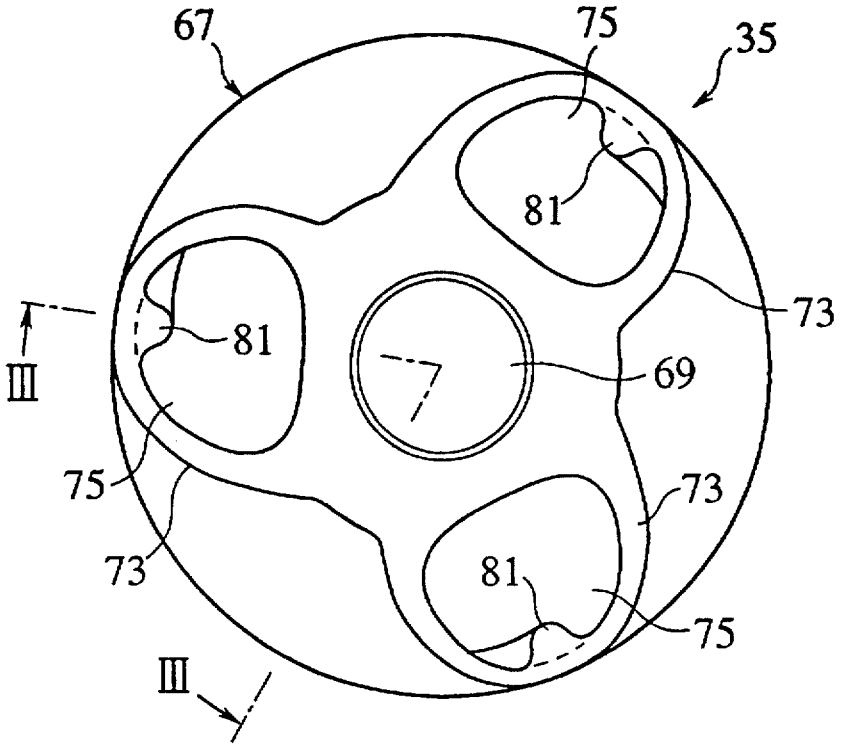
FIG. 6 is a view seen from an arrow in a VI-direction in FIG. 4 and showing an end face of the male type screw rotor seen on a sucking side thereof.
Figure 7:
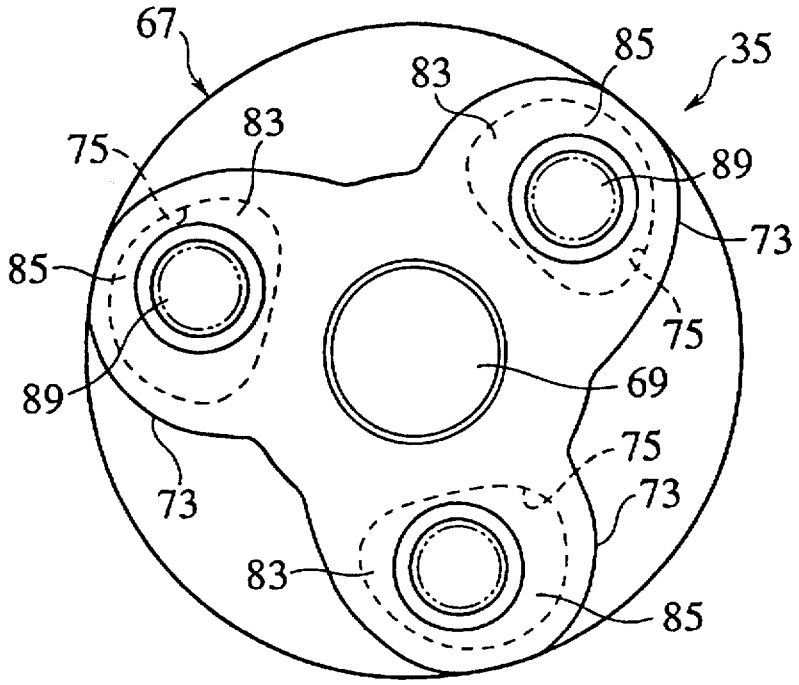
FIG. 7 is a view seen from an arrow in a VII-direction in FIG. 4 and showing an end face of the male type screw rotor seen on a discharging side thereof.

FIG. 3 is a cross-sectional view of a supercharger 1 in accordance with the first embodiment of the present invention. FIG. 4 is a front view of a male type screw rotor 35 shown in FIG. 3. FIG. 5 is an enlarged view of a main portion of the male type screw rotor 35 of FIG. 3. FIG. 6 is a view seen from an arrow in a VI-direction in FIG. 4. FIG. 7 is a view seen from an arrow in a VII-direction in FIG. 4.

As shown in FIG. 3, this supercharger 1 is constructed by an input pulley 3, a speed increasing gear set 5, a timing gear set 7, a screw type compressor (a fluid machine) 9, etc.

The input pulley 3 is supported by a compressor casing 13 through a bearing 11 and is spline-connected to an input shaft 15 and is fixed by a bolt 17 and a washer 19. The input pulley 3 is connected to a pulley on a crankshaft side through a belt. An electromagnetic clutch is arranged in this crankshaft side pulley so as to connect and disconnect an engine and the supercharger 1 from each other. The input pulley 3 is rotated by driving force of the engine through this electromagnetic clutch.

The input shaft 15 is supported by a ball bearing 21 within the interior of the casing 13. A seal 25 is arranged between the casing 13 and a collar 23 mounted to the input shaft 15 so as to prevent an oil from being leaked.

The speed increasing gear set 5 is constructed by speed increasing gears 27 and 29 respectively having large and small diameters and engaged with each other. The timing gear set 7 is constructed by timing gears 31 and 33 respectively having large and small diameters and engaged with each other. The air compressor 9 has screw rotors 35 and 37 of male and female types, respectively.

The speed increasing gear 27 having the large diameter is integrally formed in a right-hand end portion of the input shaft 15. The speed increasing gear 29 having the small diameter is connected to a rotor shaft 39 of the female type screw rotor 37 by a key 41 together with the timing gear 31 having the large diameter. Falling of the speed increasing gear 29 is prevented by a nut 43. The timing gear 33 having the small diameter is connected to a rotor shaft 47 of the male type screw rotor 35 (a hollow rotor) through a taper ring fixing mechanism 45.

In this taper ring fixing mechanism 45, the timing gear 33 is engaged with the timing gear 31 in a state in which the screw rotors 35 and 37 do not come in contact with each other. Thereafter, the taper ring fixing mechanism 45 fastens and locks the nut 49 and positions each of the screw rotors 35 and 37 in its rotating direction.

A left-hand end portion of each of the rotor shafts 47 and 39 of the respective screw rotors 35 and 37 is supported by the casing 13 by a ball bearing 51. A right-hand end portion of each of the rotor shafts 47 and 39 is supported by the casing 13 by a collar 53 and a roller bearing 55. A seal 59 is arranged between the casing 13 and a collar 57 mounted to the left-hand portion of each of the rotor shafts 39 and 47. A seal 61 is arranged between the casing 13 and the collar 53 in the right-hand end portion of each of the rotor shafts 39 and 47. The seals 59 and 61 are arranged to prevent the air from being leaked.

Driving force of the engine inputted from the pulley 3 is increased by the speed increasing gear set 5 and rotates the screw rotors 35 and 37 through the timing gear set 7. The driven compressor 9 pumps the air sucked from a sucking inlet port (a flow inlet port) 63 leftward in an axial direction between the screw rotors 35 and 37. This air is then discharged from a discharging outlet port (a flow outlet port) 65 to the engine.

As shown in FIGS. 3 and 6, the screw rotor 35 is constructed such that the rotor shaft 47 is fixed to a shaft hole 69 of a rotor body 67. Similarly, the screw rotor 37 is constructed such that the rotor shaft 39 is fixed to a shaft hole of a rotor body 71.

In the male type screw rotor 35, each of three convex tooth stripe portions 73 is formed in a spiral shape on the same axis as the shaft hole 69 into which the rotor shaft 47 is fitted.

An opening portion 77 opened on a sucking side is formed in the interior of each of the tooth stripe portions 73. A hollow portion 75 formed in a spiral shape extends from the opening portion 77 on a sucking side end face toward a discharging side end portion 79 along an axial direction of each of the tooth stripe portions 73 such that this hollow portion 75 has a thickness required for strength.

A balancer 81 is formed in the opening portion 77 on the sucking side end face. The balancer 81 is partially projected inside from an inner circumferential face of the hollow portion 75 in cross section (see FIG. 5) crossing a tooth stripe direction. The balancer 81 is arranged as a balance correcting thickness forming portion for correcting balance of the screw rotor 35 in its rotating direction.

A wall 83 is formed in the discharging side end portion 79 so as to block the hollow portion 75. A hole 87 of a baseboard for supporting a core is formed in the wall 83 and is opened. The wall 83 is projected inside from an entire region of the inner circumferential face of the hollow portion 75 in cross section (see FIG. 5) crossing the tooth stripe direction. A tooth tip side of the wall 83 constitutes a wall thickness portion 85 as a thickness forming portion for the balance correction. The wall 83 (the wall thickness portion 85) has a thickness thicker than that of the hollow portion 75.

An outside end face of each of the balancer 81 and the wall 83 (the wall thickness portion 85) is approximately formed on the same face as an end face of the rotor body 67 of the screw rotor 35.

The screw rotor 35 is manufactured by precision casting such that the hollow portion 75, the balancer 81 and the wall 83 (the wall thickness portion 85) are secured. In this precision casting, the hole 87 of the baseboard for supporting a core is formed by the wall 83 (the wall thickness portion 85). A pin 89 as a flow preventing member is fitted into this hole 87 so that the hollow portion 75 is blocked. The proper methods for fitting the pin 89 into this hole 87 are bonding, screw-tightening, welding, press fitting, and the like.

In accordance with the above construction, the screw rotor 35 is made light in weight by the hollow portion 75 formed in the interior of the tooth stripe portion 73. Accordingly, moment of inertia of the screw rotor 35 is greatly reduced.

Further, the screw rotor 35 can be balanced in its rotating direction by cutting the balancer 81 formed on the sucking side end face of the screw rotor 35 and the wall thickness portion 85 formed on the discharging side end face of this screw rotor by using a drill, etc. In particular, the wall thickness portion 85 is projected from a wide range of the inner circumferential face of the hollow portion 75 so that a processing place of the wall thickness portion 85 at a balance correcting time can be correspondingly selected in a wide range. Accordingly, the balance of the screw rotor 35 can be corrected even when the screw rotor 35 is greatly unbalanced.

As mentioned above, the balance of the screw rotor 35 can be corrected by processing the balancer 81 and the wall thickness portion 85. Therefore, different from a conventional example, it is not necessary to increase the thickness of the hollow portion and narrow the opening so as to balance the screw rotor 35. Accordingly, rotation of the screw rotor 35 can be well balanced while light weight and small moment of inertia of the screw rotor 35 are held.

In addition to this, the screw rotor 35 is reinforced by the balancer 81 near the opening portion 77. Accordingly, it is possible to prevent the tooth stripe portion 73 from being expanded even when centrifugal force is applied to the screw rotor 35 by rotating the compressor 9 at a high speed.

Thus, while the screw rotor 35 is constructed by a hollow structure to reduce its weight and moment of inertia, the rotating balance of the screw rotor 35 can be easily corrected. Further, expansion of the screw rotor 35 is prevented by strengthening the screw rotor 35 near the opening portion 77 when centrifugal force is applied to the screw rotor 35. Therefore, it is possible to prevent the screw rotors 35 and 37 from coming in contact with each other by this expansion. Further, contact, burning, vibration, etc. of the screw rotor 35 and the casing 13 are prevented. Therefore, function and performance of the screw type compressor 9 are normally held. Accordingly, when this screw rotor 35 is applied to a fluid machine, the fluid machine can be efficiently operated with respect to a use in which the fluid machine is often started, stopped, accelerated and decelerated as in the supercharger 1 of an engine for an automobile in this embodiment.

Since the rotating balance of the screw rotor 35 is easily corrected, vibration of the screw rotor 35 is reduced and durability of each of the bearings 51 and 55 is greatly improved. Further, the screw rotor 35 having a hollow structure is light in weight and its moment of inertia is extremely small so that an electromagnetic clutch for connecting and disconnecting the engine and the supercharger 1 from each other can be made compact.

The screw type compressor 9 is generally used in a high speed rotation in comparison with a fluid machine of a Roots type using a rotor having a cocoon section. Accordingly, bad influences of the screw type compressor 9 caused by vibration and centrifugal force tend to greatly appear by unbalancing the screw rotor. Accordingly, the construction of the screw rotor in the present invention is extremely advantageous in the screw type compressor 9 since the rotating balance of the screw rotor 35 is easily corrected and the screw rotor 35 has a high strength.

Further, the outside end face of each of the balancer 81 and the wall 83 (the wall thickness portion 85) is approximately formed on the same face as an end face of the rotor body 67 of the screw rotor 35 so that an end face area of each of the opening portion 77 and the discharging side end portion 79 is correspondingly increased, thereby improving a sealing property of the pressurized air. In the screw type compressor 9, the sucking inlet port 63 is formed on one side of the screw type compressor 9 in its axial direction and the discharging port 65 is formed on the other side of the screw type compressor 9. Therefore, a great pressure difference is caused between both ends of the screw rotor 35 so that effects of the improvement of efficiency by improving this sealing property are remarkable.

The balancer 81 and the wall thickness portion 85 are arranged such that the balancer 81 and the wall thickness portion 85 are projected from a tooth tip side into the hollow portion 75. Accordingly, the screw rotor 35 can be balanced simply and accurately by slightly cutting each of the balancer 81 and the wall thickness portion 85 at a balance correcting time.

Since the hollow portion 75 is blocked by the pin 89, it is possible to completely prevent a fluid from being leaked from a high pressure side end face to a low pressure side end face through the hollow portion 75 during an operation of the screw fluid machine (compressor 9). Accordingly, pressure leakage between sucking and discharging sides of the compressor 9 can be prevented.

A second embodiment of the present invention will next be described with reference to the drawings.

Figure 8:
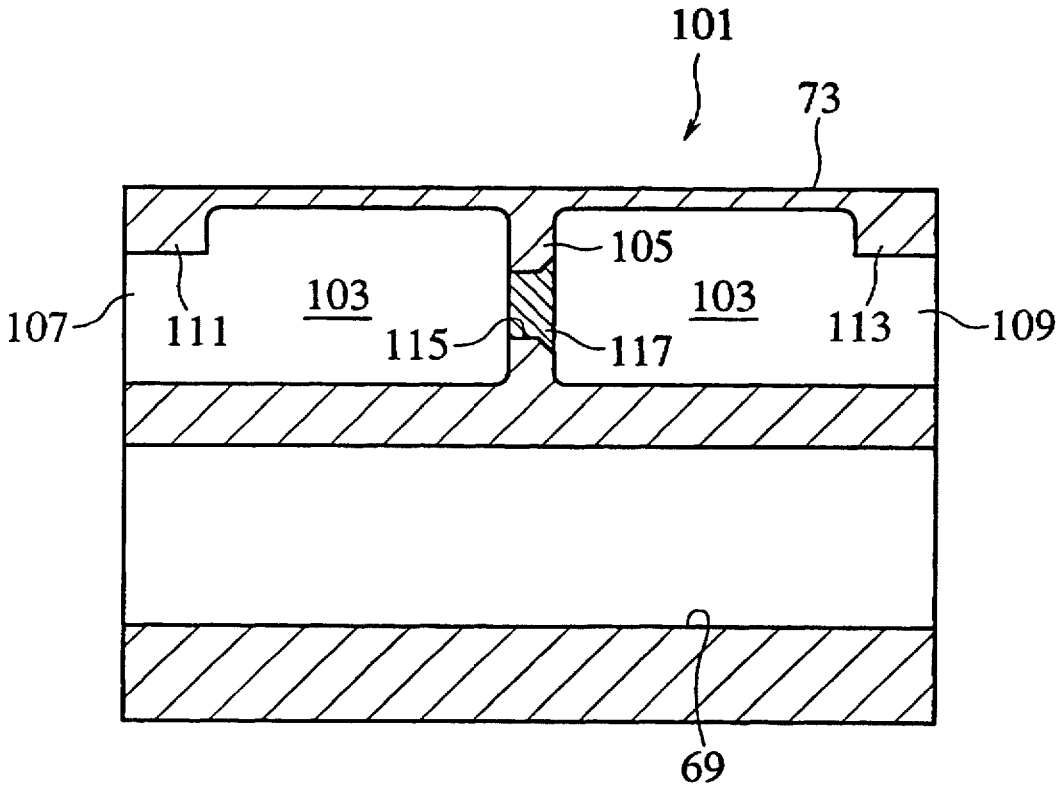
FIG. 8 is an enlarged view of a main portion of a male type screw rotor in accordance with a second embodiment of the present invention.

FIG. 8 is an enlarged view of a main portion of a male type screw rotor 101 in accordance with the second embodiment of the present invention. Functional portions similar to those in the first embodiment are designated by the same reference numerals and an overlapped explanation thereof is omitted and different points about these functional portions between the first and second embodiments will be mainly explained in the following description.

In this embodiment, a wall 105 is approximately formed in a central portion of a hollow portion 103 in its axial direction as an intermediate portion in this axial direction. Balancers 111 and 113 as balance correcting thickness forming portions for balancing the screw rotor 101 in its rotating direction are respectively formed in an opening portion 107 on a sucking side and an opening portion 109 on a discharging side such that the balancers 111 and 113 are projected inside from an inner circumferential face of the hollow portion 103. A pin 117 (a flow preventing member) is buried into a baseboard hole 115 of the wall 105.

The screw rotor 101 in this embodiment has an operation and effects similar to those in the first embodiment.

Namely, moment of inertia of the screw rotor 101 is greatly reduced by the hollow portion 103. Further, the screw rotor 101 can be balanced by cutting the balancers 111 and 113 by a drill, etc. Therefore, it is not necessary to increase a thickness of the hollow portion 103 and narrow the openings so as to balance the screw rotor. Accordingly, rotation of the screw rotor 101 can be well balanced while light weight and small moment of inertia of the screw rotor 101 are held.

The screw rotor is reinforced by the balancers 111 and 113 near the opening portions 107 and 109. Accordingly, expansion of a tooth stripe portion 73 is prevented even when the compressor 9 is rotated at a high speed and centrifugal force is applied to the compressor 9.

Thus, it is possible to prevent screw rotors 101 from coming in contact with each other by expanding the screw rotors at a high speed rotating time. Further, contact, burning, vibration, etc. between the screw rotor 101 and a casing are prevented. Therefore, function and performance of the screw rotor is normally held. Accordingly, when this screw rotor 101 is applied to a fluid machine, the fluid machine can be efficiently operated with respect to a use in which the fluid machine is often started, stopped, accelerated and decelerated as in the supercharger of an engine for an automobile in this embodiment.

Further, each of outside end faces of the balancers 111 and 113 is approximately formed on the same face as an end face of a rotor body of the screw rotor 101 so that end face areas of the opening portions 111 and 113 are correspondingly increased, thereby improving a sealing property of the pressurized air.

Further, the balancers 111 and 113 are arranged such that each of these balancers is projected from a tooth tip side into the hollow portion 103. Accordingly, the screw rotor 101 can be balanced simply and accurately by slightly cutting the balancers 111 and 113 at a balance correcting time.

Since the hollow portion 103 is blocked by the pin 117, it is possible to completely prevent a fluid from being leaked from a high pressure side end face to a low pressure side end face through the hollow portion 103 during an operation of the screw fluid machine (compressor). Accordingly, pressure leakage between sucking and discharging sides of the compressor can be prevented.

A third embodiment of the present invention will next be explained with reference to the drawings.

Figure 9:
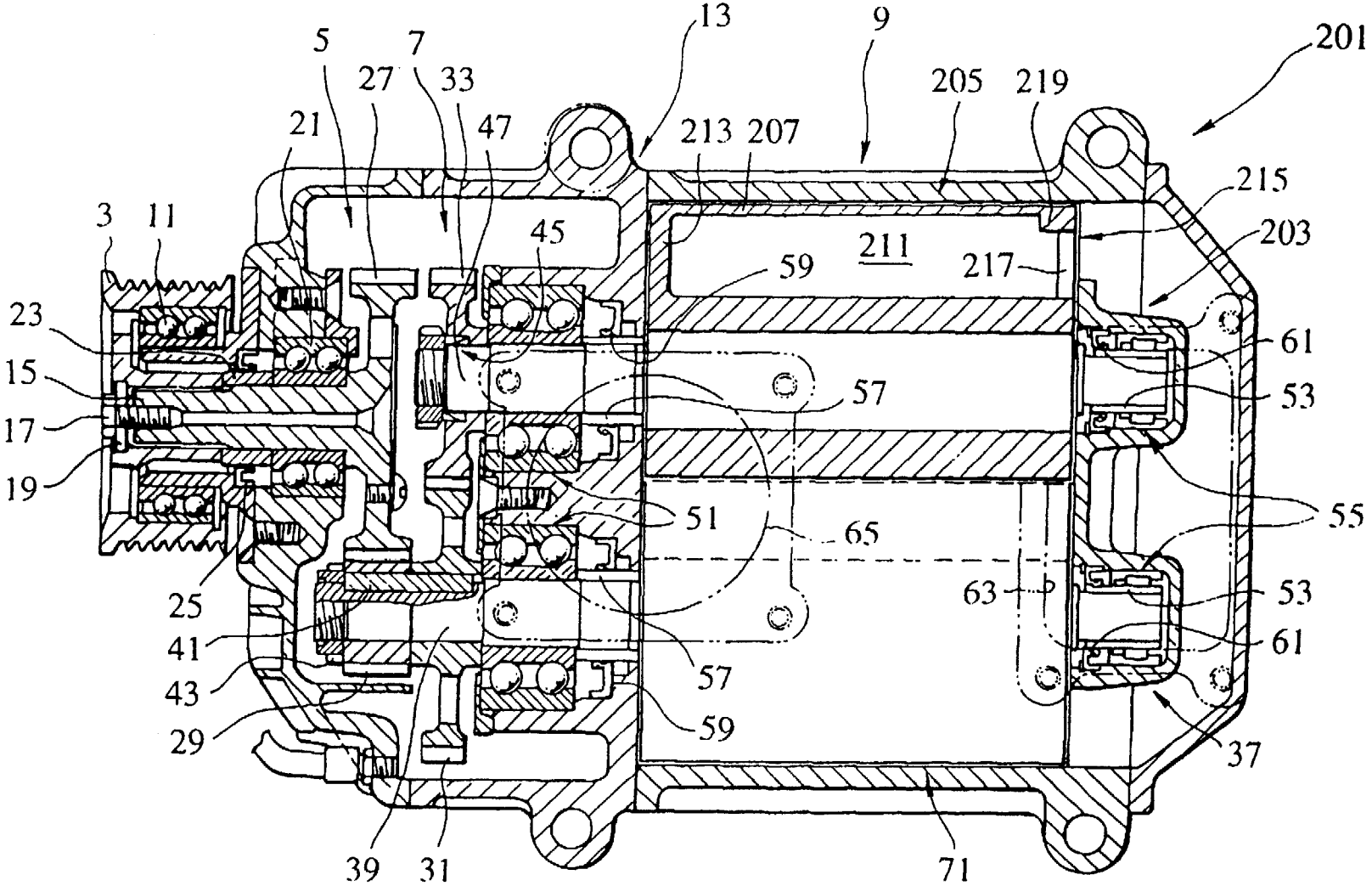
FIG. 9 is a cross-sectional view of a supercharger in accordance with a third embodiment of the present invention in which a male type screw rotor is shown in section IX—IX of FIG. 11.
Figure 10:
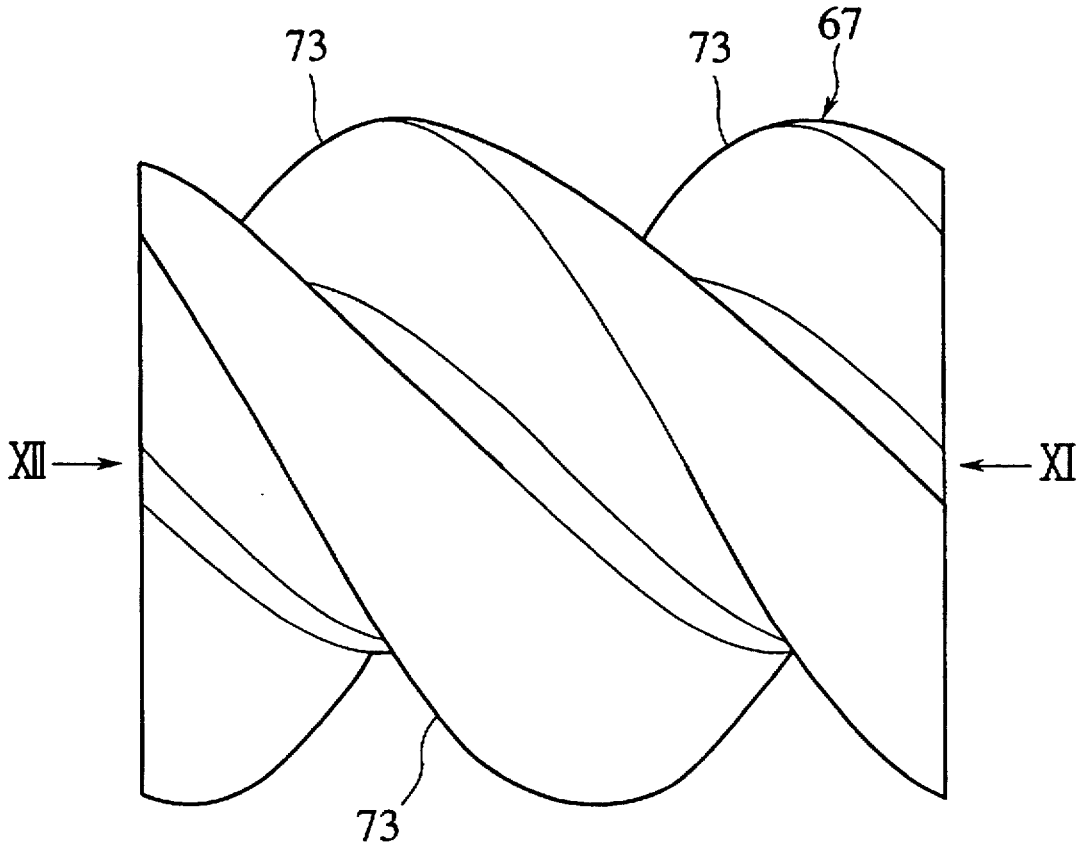
FIG. 10 is a front view of the male type screw rotor of FIG. 9.
Figure 11:
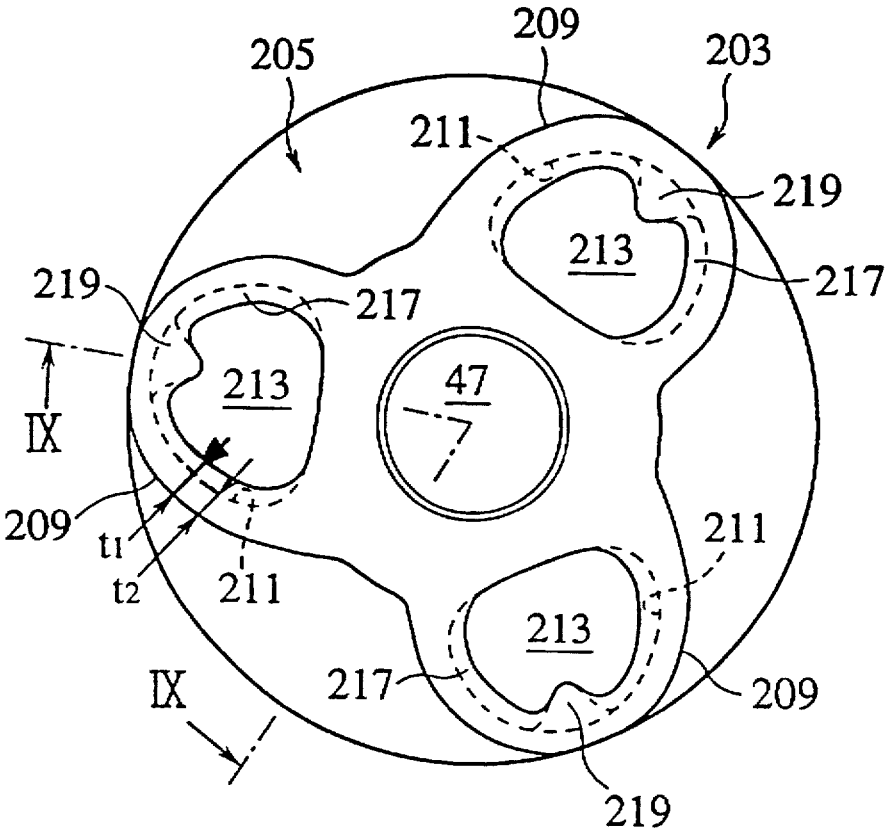
FIG. 11 is a view seen from an arrow in a XI-direction in FIG. 10 and showing an end face of the male type screw rotor seen from a discharging side thereof.
Figure 12:
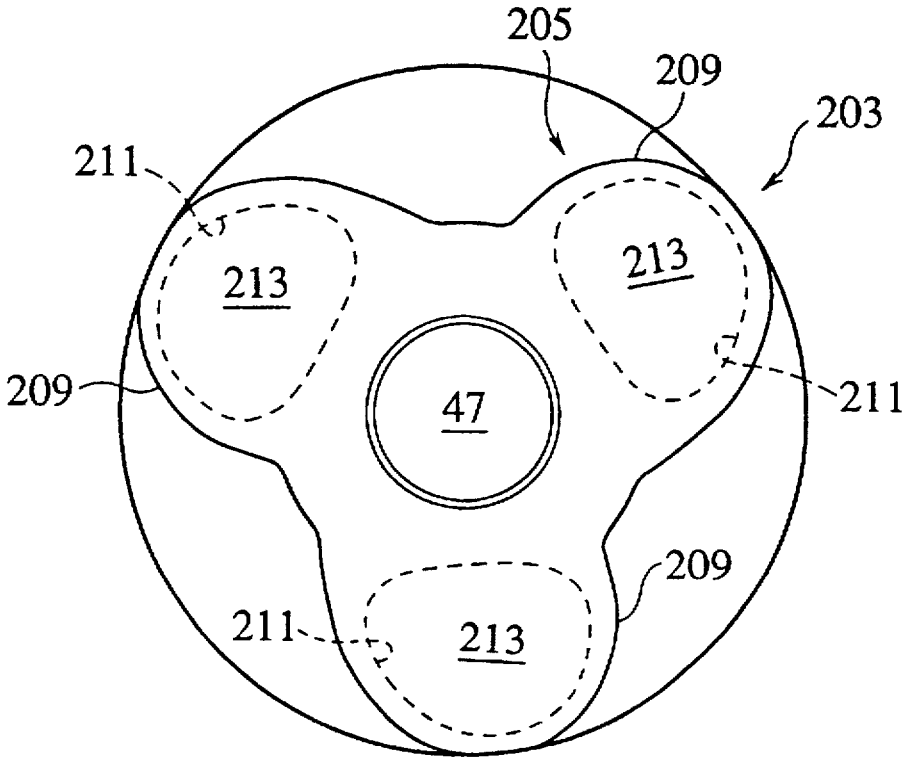
FIG. 12 is a view seen from an arrow in a XII-direction in FIG. 10 and showing an end face of the male type screw rotor seen from a sucking side thereof.

FIG. 9 is a cross-sectional view of a supercharger 201 in accordance with the third embodiment of the present invention. FIG. 10 is a front view of a male type screw rotor 203 shown in FIG. 9. FIG. 11 is a view seen from an arrow in a XI-direction in FIG. 10. FIG. 12 is a view seen from an arrow in a XII-direction in FIG. 10. Functional members similar to those in the first embodiment are designated by the same reference numerals and an overlapped explanation thereof is omitted and different points of these functional portions between the first and second embodiments will be mainly explained in the following description.

As shown in FIG. 9, the screw rotor 203 is constructed by fixing a rotor shaft 47 to a shaft hole 207 of a rotor body 205. As shown in FIGS. 10 to 12, this rotor body 205 has three tooth stripe portions 209 formed in a screw shape.

Hollow portions 211 are respectively formed in the tooth stripe portions 209 of the male type screw rotor 203. The hollow portions 211 extend in a tooth stripe direction and have the same sectional area in a rotating direction of the male type screw rotor 203. As shown in FIG. 9, a wall portion (a flow preventing member) 213 is formed on the discharging side (the left-hand side in FIG. 9) of a hollow portion 211. An opening portion 215 is formed on a sucking side (the right-hand side in FIG. 9) of the hollow portion 211. As shown in FIGS. 9 and 11, a balancer 219 and a wall thickness portion 217 as a thickness forming portion for a balance correction are formed in the opening portion 215. The wall thickness portion 217 is projected inside along an edge of the opening portion 215 in a wide range (an outside range in a diametrical direction except for the side of a rotor shaft 47) from an inner circumferential face of the hollow portion 211 in cross section (see FIG. 9) crossing the tooth stripe direction. The balancer 219 is partially projected inside from the inner circumferential face of the hollow portion 211 in the same cross section and is also projected greatly inside from the wall thickness portion 217 and is deeply projected onto a deep side from the wall thickness portion 217. Further, each of outside end faces of the wall thickness portion 217 and the balancer 219 is approximately formed on the same face as an end face of the rotor body 205 of the screw rotor 203. The hollow portion 211, the opening portion 215, etc. are formed by using a core at a casting time.

The wall portion 213 on the left-hand side blocks the hollow portion 211 and prevents pressure leakage between sucking and discharging sides of the compressor 9. As shown in FIG. 11, the wall thickness portion 217 is formed along an edge of the opening portion 215. A thickness t1 of the wall thickness portion 217 is thicker than a thickness t2 of the hollow portion 211.

The screw rotor in this embodiment also has an operation and effects similar to those in the first embodiment.

Since the screw rotor 203 is made light in weight by the hollow portion 211, moment of inertia of the screw rotor 203 is greatly reduced. Further, the screw rotor 203 can be balanced in its rotating direction by cutting the wall thickness portion 217 and the balancer 219 by a drill, etc. inserted from the opening portion 215. In particular, since the wall thickness portion 217 is formed along an edge of the opening portion 215, a processing place of the screw rotor at a balance correcting time can be correspondingly selected in a wide range. Therefore, the balance of the screw rotor 203 can be corrected even when the screw rotor 203 is greatly unbalanced.

The screw rotor 203 is reinforced by the wall thickness portion 217 and the balancer 219 near the opening portion 215. Accordingly, expansion of the tooth stripe portions 209 is prevented even when the compressor 9 is rotated at a high speed and centrifugal force is applied to the compressor. Further, since the wall thickness portion 217 is formed along the edge of the opening portion 215, the screw rotor 203 is further strongly reinforced and the expansion of the tooth stripe portions 209 is reliably prevented even when the compressor 9 is rotated at a high speed and strong centrifugal force is applied to the compressor.

Thus, while the screw rotor 203 is constructed by a hollow structure to reduce its weight and moment of inertia, the rotating balance of the screw rotor 203 can be easily corrected. Further, expansion of the screw rotor 203 is prevented by strengthening the screw rotor 203 near the opening portion 215 when centrifugal force is applied to the screw rotor 203. Therefore, it is possible to prevent screw rotors 203 and 37 from coming in contact with each other by this expansion. Further, contact, burning, vibration, etc. of the screw rotor 203 and the casing 13 are prevented.

Therefore, function and performance of the screw type compressor 9 are normally held. Accordingly, when this screw rotor 203 is applied to a fluid machine, the fluid machine can be efficiently operated with respect to a use in which the fluid machine is often started, stopped, accelerated and decelerated as in the supercharger 1 of an engine for an automobile in this embodiment.

Further, each of outside end faces of the wall thickness portion 217 and the balancer 219 is approximately formed on the same face as an end face of the rotor body 205 of the screw rotor 215 so that an end face area of the opening portion 215 is correspondingly increased, thereby improving a sealing property of the pressurized air.

Since the hollow portion 211 is blocked by the wall portion 213, it is possible to completely prevent a fluid from being leaked from a high pressure side end face to a low pressure side end face through the hollow portion 211 during an operation of the screw fluid machine (compressor 9). Accordingly, pressure leakage between sucking and discharging sides of the compressor 9 can be prevented.

Further, the balancer 219 is formed until a deep side of the hollow portion 211 from the wall thickness portion 217. Therefore, after a drill, etc. are inserted by a depth of the wall thickness portion 217 from the opening portion 215 to correct balance of the screw rotor and the wall thickness portion 217 is cut and removed, the balance of the screw rotor can be corrected by further cutting and removing the balancer 219 if the drill, etc. are further deeply inserted. Accordingly, a large cut weight amount for adjusting the rotor balance can be secured so that a balance adjusting operation can be performed further easily and precisely.

A fourth embodiment of the present invention will next be explained with reference to the drawings.

Figure 13:
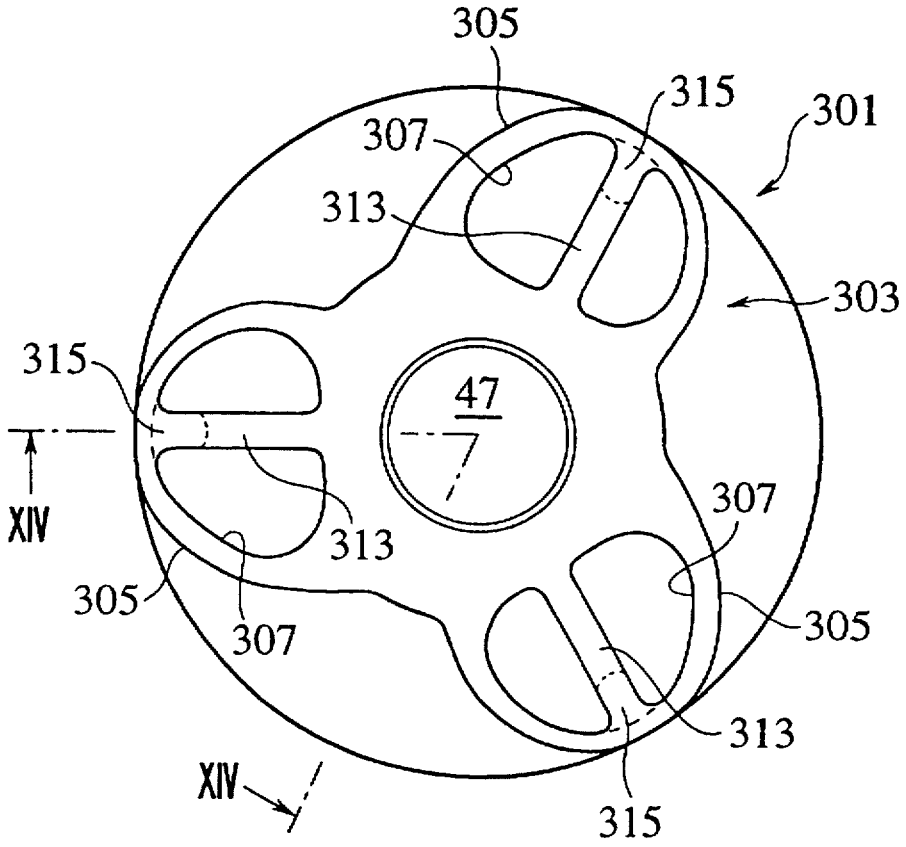
FIG. 13 is a view seen from an arrow in a XIII-direction in FIG. 14 and showing an end face of the male type screw rotor in accordance with the third embodiment of the present invention.
Figure 14:
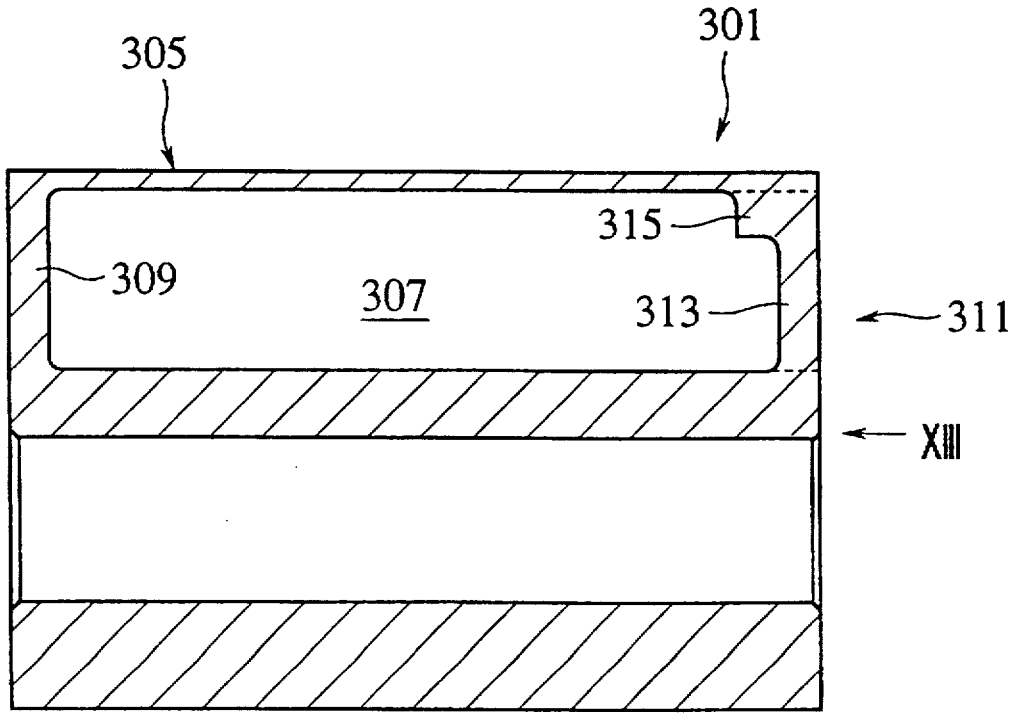
FIG. 14 is a cross-sectional view taken along line XIV—XIV of the male type screw rotor in FIG. 13.

FIG. 13 is a view seen from an arrow in a direction of XIII in FIG. 14 and showing an end face of a male type screw rotor 301 in accordance with the fourth embodiment of the present invention. FIG. 14 is an enlarged cross-sectional view of a main portion of the male type screw rotor 301 of FIG. 13. Functional members similar to those in the third embodiment are designated by the same reference numerals and an overlapped explanation thereof is omitted and different points of these functional portions between the third and fourth embodiments will be mainly explained in the following description.

As shown in FIG. 13, a rotor body 303 of the screw rotor 301 has three tooth stripe portions 305 formed in a screw shape. As shown in FIG. 14, a hollow portion 307 is formed in each of the tooth stripe portions 305. A wall portion 309 is formed on a left-hand side of the hollow portion 307 in FIG. 14. An opening portion 311 is formed on a right-hand side of the hollow portion 307. A balancer 315 and a columnar portion 313 as a thickness forming portion for a balance correction are formed in the opening portion 311. The columnar portion 313 is projected inside from an inner circumferential face of the hollow portion 307 in cross section (see FIG. 14) crossing a tooth stripe direction. The columnar portion 313 connects a tooth tip and a tooth root of each of the tooth stripe portions 305 to each other along the opening portion 311. The balancer 315 is partially projected inside from the inner circumferential face of the hollow portion 311 in the same cross section. The balancer 315 is also projected until a deep position on a deep side from the columnar portion 313. Further, each of outside end faces of the columnar portion 313 and the balancer 315 is approximately formed on the same face as an end face of the rotor body 303 of the screw rotor 301. The hollow portion 307, the opening portion 311, etc. are formed by using a core at a casting time.

The screw rotor in this embodiment has an operation and effects similar to those in the third embodiment.

Namely, the screw rotor 301 is made light in weight by the hollow portion 307 so that moment of inertia of the screw rotor 301 is greatly reduced. Further, the screw rotor 301 can be balanced in its rotating direction by cutting the columnar portion 313 and the balancer 315 by a drill, etc. inserted from the opening portion 311. In particular, since the columnar portion 313 is formed such that the columnar portion 313 covers the opening portion 311, a processing place at a balance correcting time can be correspondingly selected in a wide range. Therefore, the balance of the screw rotor 301 can be corrected even when the screw rotor 301 is greatly unbalanced.

Since the screw rotor 301 is reinforced by the columnar portion 313 and the balancer 315 near the opening portion 311, expansion of the tooth stripe portions 305 is prevented even when the compressor is rotated at a high speed and centrifugal force is applied to the compressor. Further, the columnar portion 313 connects inner circumferential faces of hollow portions 307 to each other along the opening portion 311 in a diametrical direction of the screw rotor 301. Accordingly, deformation of the tooth stripe portions 305 in the diametrical direction is further strongly restrained so that the expansion of the tooth stripe portions 305 is prevented even when the compressor is rotated at a high speed and strong centrifugal force is applied to the compressor.

Thus, while the screw rotor 301 is constructed by a hollow structure to reduce its weight and moment of inertia, rotating balance of the screw rotor 301 can be easily corrected. Further, expansion of the screw rotor 301 is prevented by strengthening the screw rotor 301 near the opening portion 311 when centrifugal force is applied to the screw rotor 301. Therefore, it is possible to prevent the screw rotor 301 from coming in contact with another screw rotor by this expansion. Further, contact, burning, vibration, etc. of the screw rotor 301 and a casing are prevented. Therefore, function and performance of the screw type compressor are normally held. Accordingly, when this screw rotor 301 is applied to a fluid machine, the fluid machine can be efficiently operated with respect to a use in which the fluid machine is often started, stopped, accelerated and decelerated as in the supercharger of an engine for an automobile in this embodiment.

Further, each of the outside end faces of the columnar portion 313 and the balancer 315 is approximately formed on the same face as an end face of the rotor body 303 of the screw rotor 301 so that an end face area of the opening portion 311 is correspondingly increased, thereby improving a sealing property of the pressurized air.

Since the hollow portion 307 is blocked by the wall portion 309, it is possible to completely prevent a fluid from being leaked from a high pressure side end face to a low pressure side end face through the hollow portion 307 during an operation of the screw fluid machine (compressor). Accordingly, pressure leakage between sucking and discharging sides of the compressor can be prevented.

Further, the balancer 315 is formed until a deep side of the hollow portion 307 from the columnar portion 313. Therefore, after a drill, etc. are inserted by a depth of the columnar portion 313 from the opening portion 311 to correct balance of the screw rotor and the columnar portion 313 is cut and removed, the balance of the screw rotor can be corrected by further cutting and removing the balancer 315 if the drill, etc. are further deeply inserted. Accordingly, a large cut weight amount for adjusting the rotor balance can be secured so that a balance adjusting operation can be performed further easily and precisely.

In each of the third and fourth embodiments, the wall portion of the screw rotor may be formed in an intermediate portion of the hollow portion as in the second embodiment. Further, opening portions may be formed at both ends of the hollow portion.

In each of the above embodiments, the three tooth stripe portions of the screw rotor are explained, but tooth stripe portions except for the three tooth stripe portions may be used.

Further, the present invention is not limited to the rotor of a screw fluid machine, but can be also applied to a rotor of a Roots type blower, etc.

Further, balance of the screw rotor cannot be corrected by only cutting, but can be also corrected by initially burying pins having different weights into holes formed in thickness forming portions for a balance correction.

Furthermore, the fluid machine of the present invention is operated as a compressor in each of the embodiments, but may be used as an expander which takes out rotating force from the rotor by providing a pressurized fluid to the rotor and cools the fluid.

What is claimed is:

1. A fluid machine comprising a casing and a pair of rotors in the casing, the pair of rotors having tooth stripe portions respectively, the pair of rotors fixed onto respective fixing shafts and being engageable with each other while input driving force is being transmitted to one rotating shaft to compress or pump a fluid, the casing having a flow inlet port and a flow outlet port of the fluid wherein at least one of the rotors has a hollow portion formed in the tooth stripe portion thereof such that the hollow portion extends along a tooth stripe direction;

the hollow portion has an opening portion opened to at least one end face of the rotor in its rotating axis direction;

the tooth stripe portion has a thickness forming portion for a balance correction, correcting the balance of the rotor in its rotating direction by cutting, projected onto an inner circumferential side of the hollow portion, and arranged in the opening portion;

the thickness forming portion for the balance correction is constructed by a balancer partially projected from an inner circumferential face of the hollow portion in cross section crossing the tooth stripe direction;

the balancer is projected from the most distant portion from a rotation axis of the rotor; and a flow preventing member for preventing a flow of the fluid along the tooth stripe direction is formed in the hollow portion.

2. A fluid machine comprising a casing and a pair of rotors in the casing, the pair of rotors having tooth stripe portions respectively, the pair of rotors fixed onto respective fixing shafts and being engageable with each other while input driving force is being transmitted to one rotating shaft to compress or pump a fluid, the casing having a flow inlet port and a flow outlet port of the fluid wherein at least one of the rotors has a hollow portion formed in the tooth stripe portion thereof such that the hollow portion extends along a tooth stripe direction;

the hollow portion has an opening portion opened to at least one end face of the rotor in its rotating axis direction;

the tooth stripe portion has a thickness forming portion for a balance correction, correcting the balance of the rotor in its rotating direction by cutting, projected onto an inner circumferential side of the hollow portion, and arranged in the opening portion;

the thickness forming portion for the balance correction is constructed by a wall thickness portion projected in a wide range from an inner circumferential face of the hollow portion in cross section crossing the tooth stripe direction; and a flow preventing member for preventing a flow of the fluid along the tooth stripe direction is formed in the hollow portion.

3. A fluid machine comprising a casing and a pair of rotors in the casing, the pair of rotors having tooth stripe portions respectively, the pair of rotors fixed onto respective fixing shafts and being engageable with each other while input driving force is being transmitted to one rotating shaft to compress or pump a fluid, the casing having a flow inlet port and a flow outlet port of the fluid wherein at least one of the rotors has a hollow portion formed in the tooth stripe portion thereof such that the hollow portion extends along a tooth stripe direction;

the hollow portion has an opening portion opened to at least one end face of the rotor in its rotating axis direction;

the tooth stripe portion has a thickness forming portion for a balance, correcting the balance of the rotor in its rotating direction by cutting, projected onto an inner circumferential side of the hollow portion, and arranged in the opening portion;

the thickness forming portion for the balance correction is constructed by a columnar portion connecting inner circumferential faces on a tooth tip side and a tooth root side to each other along the opening portion in cross section crossing the tooth stripe direction; and a flow preventing member for preventing a flow of the fluid along the tooth stripe direction is formed in the hollow portion.

* * * * *